US008484781B2

(12) United States Patent
Kong

(10) Patent No.: US 8,484,781 B2
(45) Date of Patent: Jul. 16, 2013

(54) ADJUSTABLE BED

(76) Inventor: Wan Ping Kong, Zhejiang (CN)

( * ) Notice: Subject to any disclaimer, the term of this patent is extended or adjusted under 35 U.S.C. 154(b) by 319 days.

(21) Appl. No.: 12/456,966

(22) Filed: Jun. 25, 2009

(65) Prior Publication Data

US 2010/0325799 A1 Dec. 30, 2010

(51) Int. Cl.
*A61G 7/015* (2006.01)
*A61G 7/018* (2006.01)

(52) U.S. Cl.
USPC ..... 5/618; 5/613; 5/616

(58) Field of Classification Search
USPC ..... 5/600, 613, 617, 618, 616, 614
See application file for complete search history.

(56) References Cited

U.S. PATENT DOCUMENTS

2001/0000828 A1* 5/2001 Hensley ..... 5/618
2005/0076440 A1* 4/2005 Taguchi et al. ..... 5/618
2007/0163046 A1* 7/2007 Eriksson et al. ..... 5/618
2010/0325799 A1* 12/2010 Huang ..... 5/616
2010/0325800 A1* 12/2010 Huang ..... 5/618

FOREIGN PATENT DOCUMENTS

CN 101380174 * 3/2009

* cited by examiner

*Primary Examiner* — Robert G Santos
(74) *Attorney, Agent, or Firm* — Clement Cheng

(57) ABSTRACT

The present invention relates to a type of adjustable bed having junctions with equipped back support board, calf board support, front part bridge piece, back board support, rear bridge piece, thigh board support, back board support end and underframe crosstie woggle joint. The back board support has another end and is connected to the bedboard's back board woggle joint. A calf board support end and underframe crosstie woggle joint, and calf board support a calf of a user. Electrical machinery connection actuates the board members. A roller raises the back support and a separate roller raises the thigh board support. This model utility bed headboard footboard and the bed frame use the KD type card to meet.

2 Claims, 5 Drawing Sheets

ADJUSTABLE BED

The present invention claims priority from Wan Ping Kong China patent ZL 2008 1 0121620.5 (application number 200810121620.5) filed Oct. 14, 2008.

FIELD OF THE INVENTION

The invention is in the field of electrically operated adjustable bed mechanisms. This invention involves a kind of adjustable bed mechanism, mainly used in adjustable electrically operated beds.

DISCUSSION OF RELATED ART

In presently existing technology, a variety of electrically controlled adjustable beds are used for adjusting the position of a user. Unfortunately, the construction has been complicated, expensive and bulky. Also, the adjustment functions are limited. Therefore, the present invention seeks to present an improved electrically controlled adjustable bed.

SUMMARY OF THE INVENTION

The adjustable bed has electrical control of a lower thigh board portion and a back board portion. From a flat position, the lower sideboard and back board can be independently raised to a maximum inclination angle. The apparatus has a variety of parts including a back board support, and a calf board support, both of which are attached to a fixed base plate which remains prone. A bridge piece is attached to the bottom of the fixed base plate. The bridge piece has a pair of sections including the front part bridge piece rear bridge piece also called the behind part bridge piece. A back board support is made as a frame or member pressing up to support the back board. The rear bridge piece has a connection to the thigh board support.

A tail block film threading is preferably formed as a plate upon which a slot pocket shaped foot board film threading fixes on top of. The end plate films threading attaches to the foot board for securing the foot board. The head film threading analogously secures the bed headboard film threading to the headboard. The adjustable bed has a back board support end and electrical control bed underframe crosstie hinge joints. A back board support is hinge jointed and another end of the bed board's back board is hinge jointed. A calf board support end is connected to underframe crosstie hinge joint for moving and supporting the calf board support. The other end of the calf board has a calf board bridge piece for support.

The electrical motor assemblies include a forward electrical motor assembly and a rear electrical motor assembly. The forward electrical motor assembly and the rear electrical motor assembly are preferably widthwise offset so that one is on the right and the other is on the left part of the under portion of the bed.

The user can adjust the thigh board through the electrical motor machinery for operating and controlling thigh board and calf board angles. The electrical machinery also drives the bridge piece, and the thigh board support to rotate on an axle. The thigh board support is supported by a roller which raises the thigh board to a continuously variable desired inclination angle gradually as the user desires. The calf board and the thigh board therefore are both continuously variable in inclination angle. The calf board support restricts the motion of the calf board so that preferably the thigh board has a maximum inclination angle of approximately 59 degrees. The preferred maximum angle between the calf board and thigh board is 113°.

The rear electrical motor assembly is connected to the front bridge piece which is secured to the fixed base plate. The front electrical motor assembly is connected to the rear bridge piece which is secured to the fixed base plate. The bed is supported on a bed board support which in turn is supported on a pair of front rollers and a pair of rear rollers that roll on an underframe crosstie. The underframe crosstie is formed as a pair of rails or tracks upon which a front left roller, a front right roller, a rear left roller and a rear right roller roll on. The rolling of the bed is relative to the underframe crosstie, and is restricted by the backboard support which is pivotally connected to the underframe crosstie at a lower end and pivotally connected to a backboard bridge piece at an upper end. The first electrical machinery bridge piece forms an angle with the backboard support member. The second electrical machinery bridge piece forms an angle with the thigh board support member. The back board bridge piece is connected to the backboard, which in turn is pivotally connected to the fixed base plate.

Figure 1:
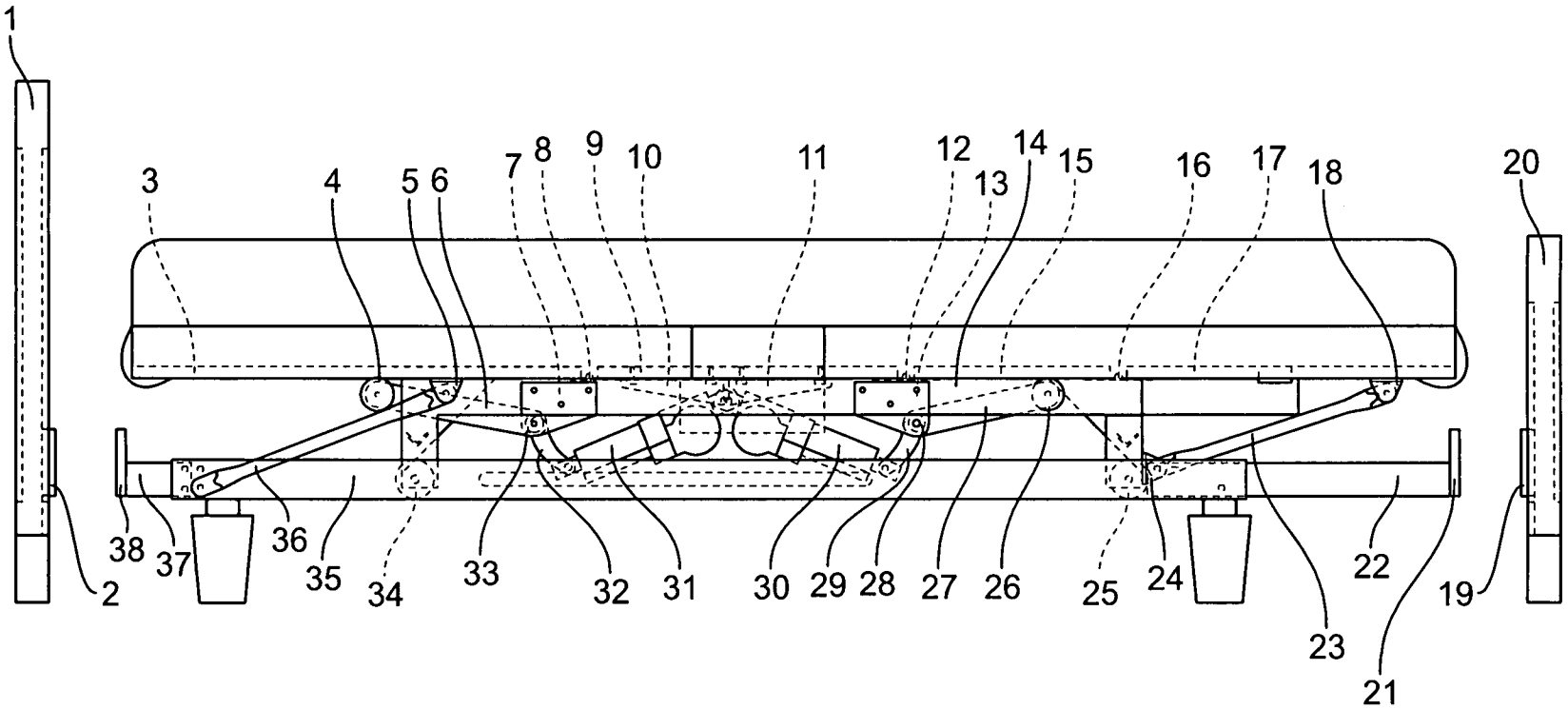
FIG. 1 is a schematic of the present invention showing the structure of the adjustable bed when set level, showing the mattress on top of the adjustable structure and the headboard connection.
Figure 2:
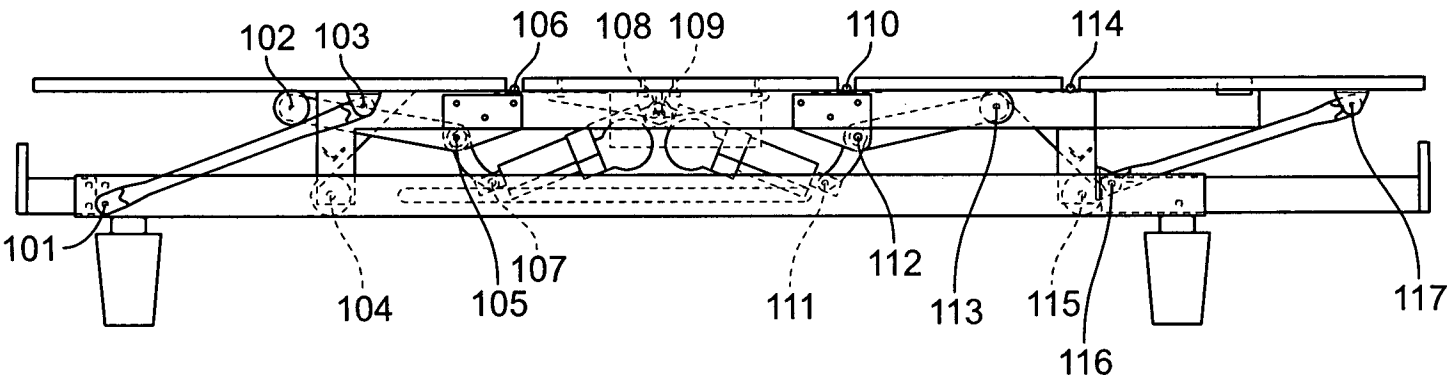
FIG. 2 is a schematic drawing of the present invention showing main revolution axes.

Due to the large number of moving parts, the reader is invited to review the list of elements in the drawings before reviewing the detailed description of the preferred embodiment. The drawings disclosing the present invention refer to elements listed as follows:

Bed Headboard 1
Film Threading 2
Back Board 3
Back Board Roller 4
Back Board Bridge Piece 5
First Back Board Support 6
First Fixed Bridge Piece 7
Back Board Hinge 8
Fixed Base Plate 9
Front Bridge Piece 10
Rear Bridge Piece 11
Thigh Board Hinge 12
Thigh Board Bridge Piece 13
Bed Board Support 14
Thigh Board 15
Calf Board Hinge 16
Calf Board 17
Calf Board Bridge Piece 18
Film Threading 19
Foot board 20
Film Threading 21
Foot board Bridge Piece 22
Calf Board Support 23
Calf Board Support Bridge Piece 24
Aft Bed board Support Roller 25

Thigh Board Roller 26
Thigh Board Support 27
Behind Bridge Piece 28
Second Electrical Machinery Bridge Piece 29
Rear or Second Electrical Motor Assembly 30
Front or First Electrical Motor Assembly 31
First Electrical Machinery Bridge Piece 32
Front Part Bridge Piece 33
Fore Roller 34
Underframe Crosstie 35
Second Back Board Support 36
Bed headboard Bridge Piece 37
Film Threading 38
First Revolution Axis 101
Second Revolution Axis 102
Third Revolution Axis 103
Fourth Revolution Axis 104
Fifth Revolution Axis 105
Sixth Revolution Axis 106
Seventh Revolution Axis 107
Eighth Revolution Axis 108
Ninth Revolution Axis 109
Tenth Revolution Axis 110
Eleventh Revolution Axis 111
Twelfth Revolution Axis 112
Thirteenth Revolution Axis 113
Fourteenth Revolution Axis 114
Fifteenth Revolution Axis 115
Sixteenth Revolution Axis 116
Seventeenth Revolution Axis 117

DETAILED DESCRIPTION OF THE PREFERRED EMBODIMENT

As seen in figure FIGS. 1-5, the preferred embodiment of the adjustable bed includes a bed headboard 1, a film threading 2 outside the bed head plate, a back board 3; a back board roller 4; a back board bridge piece 5; a first back board support 6; a first fixed bridge piece 7; a back board hinge 8; a fixed base plate 9; front bridge piece 10; a rear bridge piece 11; a thigh board hinge 12; thigh board bridge piece 13; a bed board support 14; a thigh board 15; a calf board hinge 16; a calf board 17; a calf board bridge piece 18; an outside foot board film threading 19; a foot board 20; a foot board film threading 21; a foot board bridge piece 22; a calf board support 23; a calf board support bridge piece 24; an aft bed board support roller 25; a thigh board roller 26; a thigh board support 27; a behind bridge piece 28; a rear or second electrical machinery bridge piece 29; a rear or second electrical motor assembly 30; a front or first electrical motor assembly 31; a first electrical machinery bridge piece 32; a front part bridge piece 33; a before bed board support, fore roller 34; an underframe crosstie 35; a second back board support 36; a bed headboard bridge piece 37; and an in bed headboard film threading 38. Also, there is a controller for controlling the second electrical motor assembly in the front electrical motor assembly. The controller is preferably wired and having wires to connect to the pair of electrical motor assembly under the bed. The controller would at the very least have a power control for turning on and turning off the power. The controller would have a first control for raising and lowering the angle of the backboard and a second control for raising and lowering the angle of the thigh board. The controllers can be made according to commonly available technology. The first electrical motor assembly and the second electrical motor assembly both have an extending arm for extending the length of the electrical motor assembly. The extending arm is also commonly available technology.

The present embodiment includes a bed board support 14 formed as a rigid frame supporting a plurality of boards attached to a fixed base plate 9. The fixed base plate 9 is permanently rigidly connected to the bed board support 14. A first actuate bridge piece also called the rear bridge piece 11 is rigidly secured to fixed base plate 9. The first electrical motor assembly 31 is pivotally connected to actuate against the bridge piece 11 at the ninth revolution axis 109 rotation connection when the first electrical motor assembly extends or contracts its length. The first electrical motor assembly 31 actuates and is pivotally connected to a first electrical machinery bridge piece 32 at an end portion which in turn rotates on the seventh revolution axis 107 rotation connection. The angle between the first electrical motor assembly 31 and the first electrical machinery bridge piece 32 decreases when the first electrical motor assembly 31 extends in length. The first electrical machinery bridge piece 32 rotates clockwise upon length extension of the first electrical motor assembly 31.

The first electrical machinery bridge piece 32 has another end that is rigidly connected to and actuates a front part bridge piece 33. The first back board support 6 end and front part bridge piece 33 have a rigid permanent connection such that the angle between them does not change during extension of the first electrical motor assembly 31. The front part bridge piece 33 is pivotally connected to first fixed bridge piece 7 and pivots clockwise on the fifth revolution axis 105 rotation connection. The first fixed bridge piece 7 and bed board support 14 are in rigid permanent connection.

The back board roller 4 installs on a second revolution axis 102 on the first back board support 6. Another end of the backboard has the back board bridge piece 5 in permanent connection with the back board 3. A second back board support 36 has an end and the back board bridge piece 5 pivot on the third revolution axis 103 rotation connections. The second back board support 36 has another end which is a lower end that is pivotally connected to the underframe crosstie 35 at the first revolution axis 101 rotation connection. Before the bed board support, the roller 34 installs on the fourth revolution axis 104 and the roller 34 rolls on the underframe crosstie 35.

The bed board support 14 front portion, is in rigid permanent connection with bridge piece 10 and fixed base plate 9. The rear electrical motor assembly 30 rear portion when actuated pivots in relation with the bridge piece 10 on the eighth revolution axis 108 rotation connection. The rear electrical motor assembly 30 front portion is pivotally connected and actuates a second electrical machinery bridge piece 29 end on the 11th revolution axis 111 rotation connection. The second electrical machinery bridge piece 29 has another end with the behind bridge piece 28 in rigid permanent connection. A thigh board support 27 has an end that is pivotally connected to the behind bridge piece 28, behind the behind bridge piece 28 on the securing bridge piece 13 via the 12th revolution axis 112 rotation connection.

The securing bridge piece 13 is rigidly connected to the bed board support 14. The thigh board support 27 has another end upon which is installed the thigh board roller 26 via the 13th revolution axis 113. The calf board bridge piece 18 is rigidly mounted to the calf board 17 and a calf board support 23 has an end that connects to the calf board bridge piece 18 on a 17th revolution axis 117 rotation connection. The calf board support 23 has another end in pivotal connection with calf board support bridge piece 24 via a 16th revolution axis 116 rotation connection.

A calf board support bridge piece 24 is rigidly permanently connected to bed board support 14. Below that, the bed board support has a roller 25 installed on the 15th revolution axis 115 which is mounted on the bed board support 14 lower portion. A back board hinge 8 connects to a lower end of the back board 3. The back board hinge 8 has another end that is connected to the fixed base plate 9. Similarly, a thigh board hinge 12 has an end that is mounted to the fixed base plate 9 in pivotal permanent connection. The thigh board hinge 12 has another end that is permanently connected to the thigh board 15. The calf board hinge 16 has an end permanently connected to thigh board 15. The calf board hinge 16 also has another end that is permanently connected to calf board 17.

The outside bed headboard film threading 2 and bed headboard 1 are in permanent connection. The bed headboard film threading 38 formed as a bracket and bed headboard bridge piece 37 are in permanent connection. The bed headboard bridge piece 37 and the underframe crosstie 35 are in permanent connection. The outside bed headboard film threading 2 and inside bed headboard film threading 38 have coordinating geometry to fit together. The outside foot board film threading 19 and foot board 20 have permanent connection. The foot board film threading 21 and foot board bridge piece 22 have permanent connection. The foot board bridge piece 22 and underframe crosstie 35 are in permanent connection. The outside foot board film threading 19 and inside foot board film threading 21 have coordinations such that coordinating geometry allows them to fit together.

The interface of this invention's film threading preferably uses a known industry standard where an angled planar member secures and fits inside an angled pocket.

During practical application, the user uses the controller to activate and cause the front electrical motor assembly 31 rear part to rotate the bed by pushing against the ninth revolution axis 109 which rotates and drives the electrical machinery bridge piece 32 and the first back board support 6 on the fifth revolution axis 105 in rotation. The front electrical motor assembly 31 is also called the first electrical motor assembly 31. The first electrical machinery 31 pushes the first electrical machinery bridge piece 32 on the seventh revolution axis 107 in rotation. The first back board support 6 on back board rollers 4 rotates about the second revolution axis 102, supports the back board 3 and rotates about the sixth revolution axis 106 to increase the climb of the inclination angle gradually to a desired angle. The backboard support 6 also causes the backboard support 36 to increase the inclination angle relative to the underframe crosstie 35 that rotates on first revolution axis 101. The third revolution axis 103 allows the back board rotation to a certain angle, and also raises the roller 34 and the bed board support. The roller 25, as the bed levels, approaches slowly toward the underframe crosstie 35 front end. This embodiment preferably establishes a back board 3 having a maximum inclination angle of 58 degrees. See FIG. 3.

Similarly, the user can control the rear electrical motor assembly 30 rear parts through the controller to revolve on the eighth revolution axis 108 and actuate the second electrical machinery bridge piece 29. After the front end elongation of the rear electrical motor assembly 30, the second electrical machinery bridge piece 29 in turn raises the thigh board support 27 which rotates on the 12th revolution axis 112. Below the rear electrical motor assembly 30 is the second electrical machinery bridge piece 29 rotating on the 11th revolution axis 111 which allows rotation of the electrical machinery bridge piece. The thigh board support 27 has thigh board rollers 26 that rotate about the 13th revolution axis 113. The thigh board rollers 26 support the thigh board 15 which rotates about the tenth revolution axis 110. This raises the inclination angle gradually to a desired level. Simultaneously, the calf board 17 rises in proportion to the inclination angle and moves relative to the underframe crosstie 35 which rotates about the 14th revolution axis 114.

Figure 3:
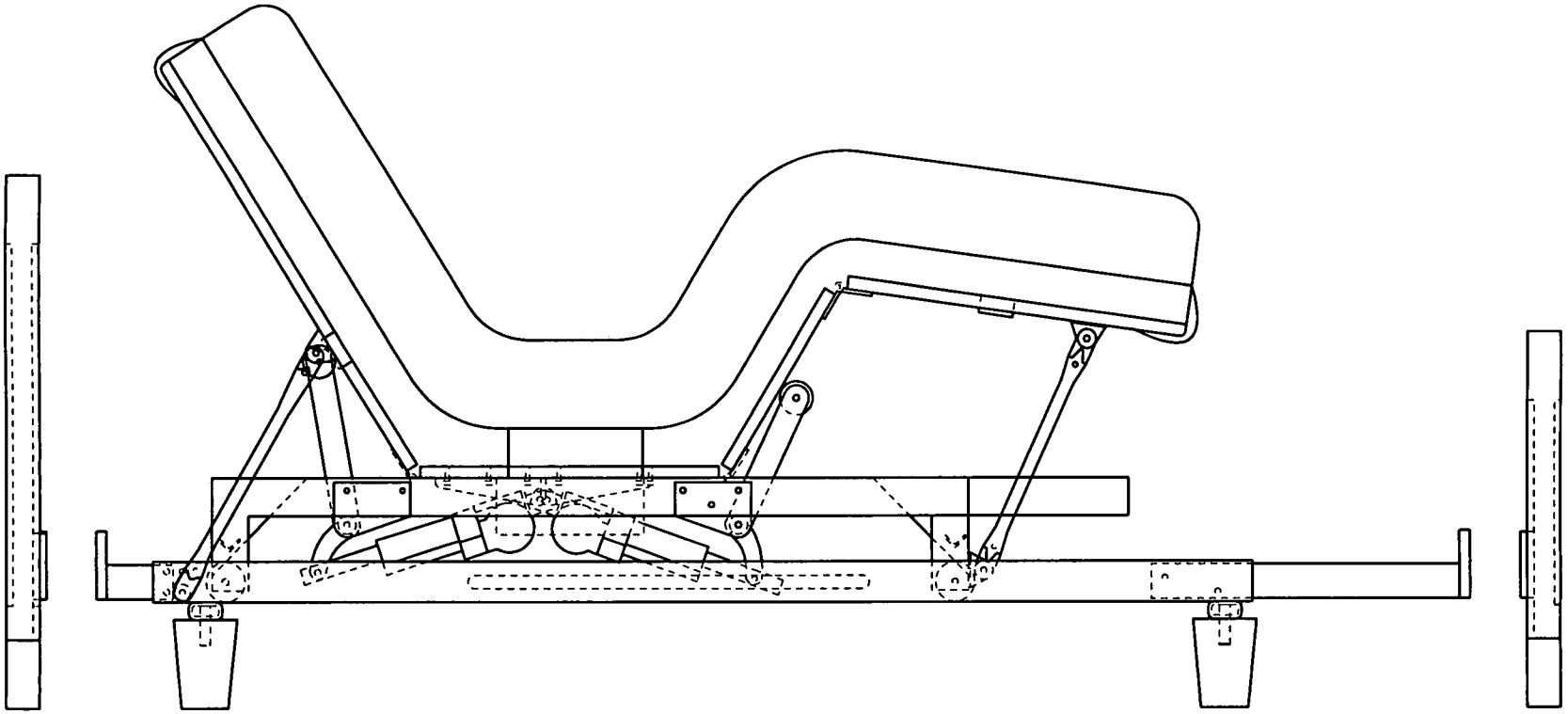
FIG. 3 is a drawing of the apparatus in raised position with raised forehead and raised thigh portion.
Figure 4:
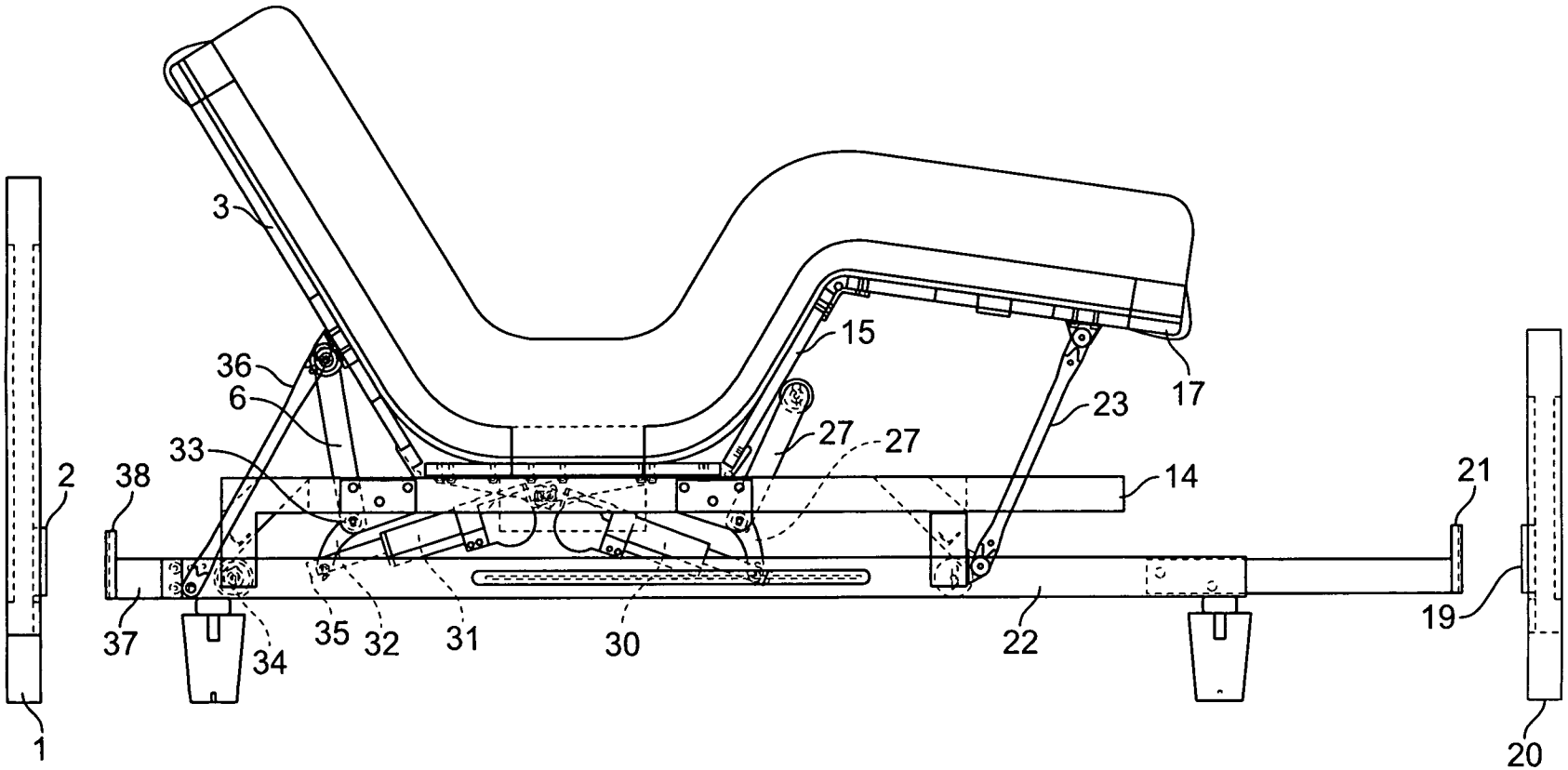
FIG. 4 is a drawing of the apparatus in raised position with raised forehead and raised thigh portion.
Figure 5:
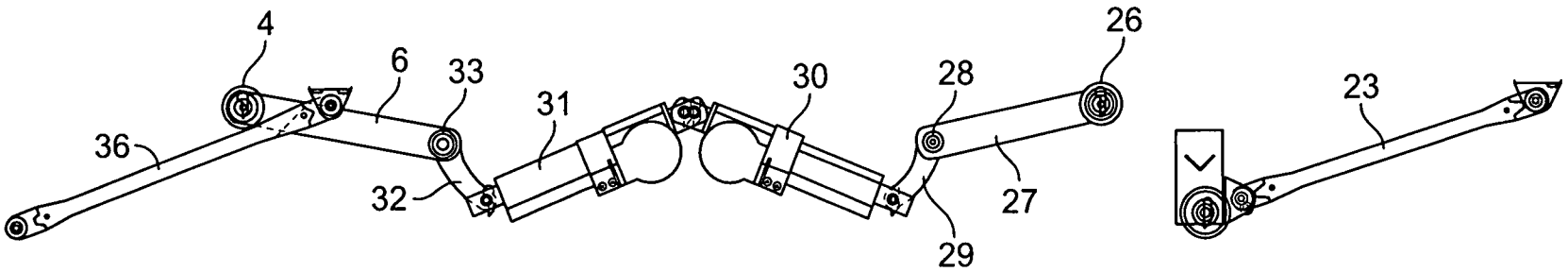
FIG. 5 is a drawing of the mechanical apparatus and structural elements that support the boards of the bed.

The thigh board 15 rises to a certain angle along with the thigh board, and raises the calf board support 23 which pivots on the 16th revolution axis 116 and the 17th revolution axis 117. The thigh board 15 rises relative to the underframe crosstie 35 to a certain angle. In this preferred embodiment, the final thigh board 15 maximum inclination angle is preferably about 59°. Between the calf board 17, and the thigh board 15 the smallest inside angle is preferably about 113 degrees again as seen in FIG. 3. In this embodiment, the front electrical motor assembly 31 and rear electrical motor assembly 30 may simultaneously or independently move the bed under the user's control. The back portion and the side portion can be activated independently. In this preferred embodiment, the revolution axis prefers usage of a bolt, pin or rivet.

While the presently preferred form of the system has been shown and described, and several modifications thereof discussed, persons skilled in this art will readily appreciate that various additional changes and modifications may be made without departing from the spirit of the invention, as defined and differentiated by the following claims.

The invention claimed is:

1. An adjustable bed comprising:

a. an underframe crosstie;

b. a pair of bed board support rollers supported by the underframe crosstie, wherein the underframe crosstie forms a track supporting the pair of bed board support rollers;

c. a bed board support formed as a frame, wherein the bed board support is supported by the pair of bed board support rollers;

d. a fixed base plate secured to the bed board support;

e. a back board; attached in a hinged connection to the fixed base plate;

f. a first back board support, wherein the first back board support has a first revolution axis mounted on an upper end of the first back board support, wherein a back board roller is mounted on the first revolution axis, wherein the back board roller rolls on a lower surface of the back board when raising the back board, wherein the first back board support has a back board support lower end pivotally connected to the under frame crosstie, wherein the first back board support has rigid permanent connection to a front part bridge piece such that the angle between the first back board support and the front part bridge piece does not change, wherein the front part bridge piece acts as a lever to raise the backboard by raising the first back board support having the back board roller, wherein the front part bridge piece is shorter than the first back board support;

g. a second back board support that supports the back board; wherein the second back board support is pivotally connected to the underframe crosstie, and wherein the second back board support is pivotally connected to the back board;

h. a first electrical motor assembly which has a first electrical motor assembly extending arm for increasing length; wherein the front part bridge piece is pivotally connected to the first electrical motor assembly extending arm;

i. a thigh board attached in a hinged connection to the fixed base plate;

j. a thigh board support mounted under the thigh board; wherein the thigh board support has a thigh board roller mounted on an upper end of the thigh board support, wherein the thigh board roller rolls on a lower surface of the thigh board when raising the thigh board, wherein the thigh board support is pivotally mounted to the underframe crosstie, wherein the thigh board support is rigidly connected to an electrical machinery bridge piece that acts as a lever for raising the thigh board;

k. a second electrical motor assembly which has a second electrical motor assembly extending arm for increasing length; wherein the electrical machinery bridge piece is pivotally connected to the second electrical motor assembly extending arm to lift the thigh board when the second electrical motor assembly is controlled by a controller to increase in length; and l. a calf board attached in a hinged connection to the thigh board.

2. The adjustable bed of claim 1, further comprising:

a. a calf board support member pivotally connected to the calf board at a calf board support member upper end, and pivotally connected to the bed board support at a calf board support member lower end.

* * * * *